United States Patent [19]

Dunn

[11] 4,265,192

[45] May 5, 1981

[54] AUXILIARY HYDRAULIC MANEUVERING SYSTEM FOR SMALL BOATS

[76] Inventor: Garf L. Dunn, 31120 Hunter Dr., Farmington Hills, Mich. 48018

[21] Appl. No.: 9,106

[22] Filed: Feb. 5, 1979

[51] Int. Cl.[3] ..... B63H 25/46

[52] U.S. Cl. ..... 114/151; 440/40

[58] Field of Search ..... 115/12 R, 11, 14, 16; 114/144 E, 150, 151; 60/221, 222, 229; 440/38, 40

[56] References Cited

U.S. PATENT DOCUMENTS

| | | | |
|---|---|---|---|
| 3,132,477 | 5/1964 | Egger | 115/12 R |
| 3,209,717 | 10/1965 | Campbell et al. | 114/151 |
| 3,248,876 | 5/1966 | Parsons | 115/12 R |
| 3,339,516 | 9/1967 | Lenci | 115/12 R |
| 3,478,965 | 11/1969 | Llewellyn | 60/229 |
| 3,675,611 | 7/1972 | Glass | 115/12 R |
| 3,782,320 | 1/1974 | Groves, Jr. | 115/12 R |
| 3,797,447 | 3/1974 | Stubblefield | 115/12 R |

*Primary Examiner*—Sherman D. Basinger

[57] ABSTRACT

A hydraulic pump driven by any suitable power source, such as by an electric motor energized from a storage battery supplies water under hydraulic pressure by way of a control valve unit to a plurality of pairs of downwardly and outwardly-inclined nozzles disposed at various locations around the boat's hull above the water line thereof. These include a forwardly-located pair of nozzles on the starboard and port sides respectively and also three pairs of nozzles near the stern of the boat, the first pair upon the starboard and port sides being directed downward and forward for backward maneuvering, the second pair being directed downward and outward on the starboard and port sides respectively for side-wise maneuvering, and the third pair being directed downward and rearward also on the starboard and port sides for forward maneuvering. A first modification makes use of a downwardly and rearwardly directed nozzle with an optional flow-reversing deflector amidships on the transom of the boat. A second modification makes use of solenoid-operated valves controlled from a central control switch unit.

1 Claim, 8 Drawing Figures

FIG. 1
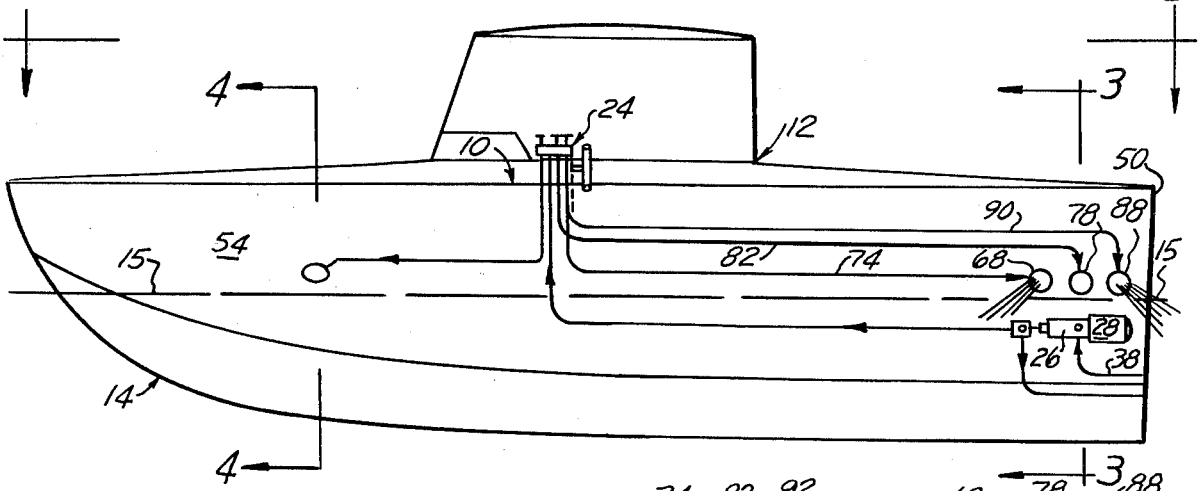
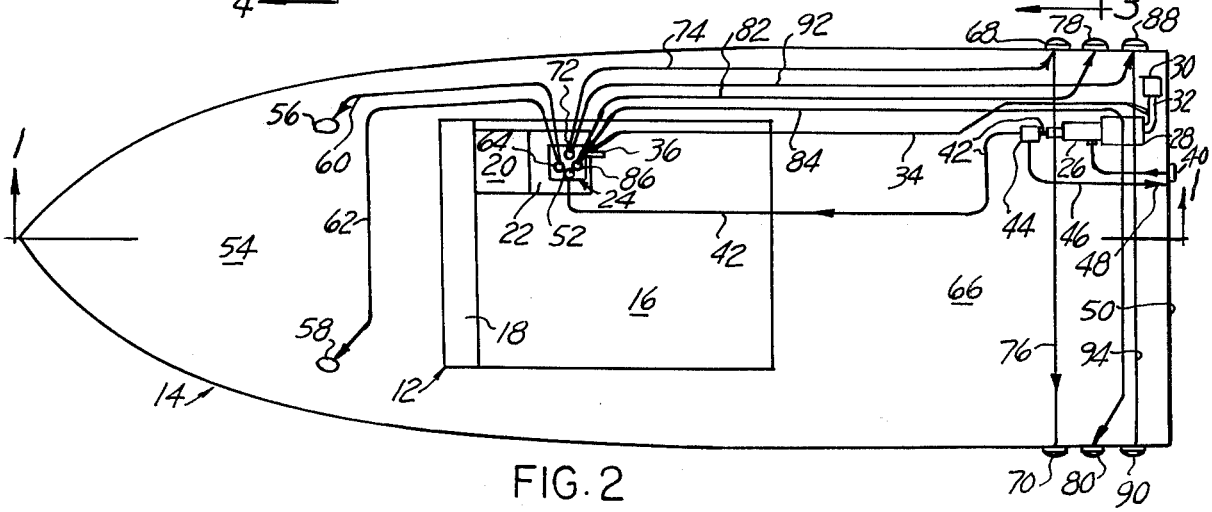
FIG. 2
FIG. 3
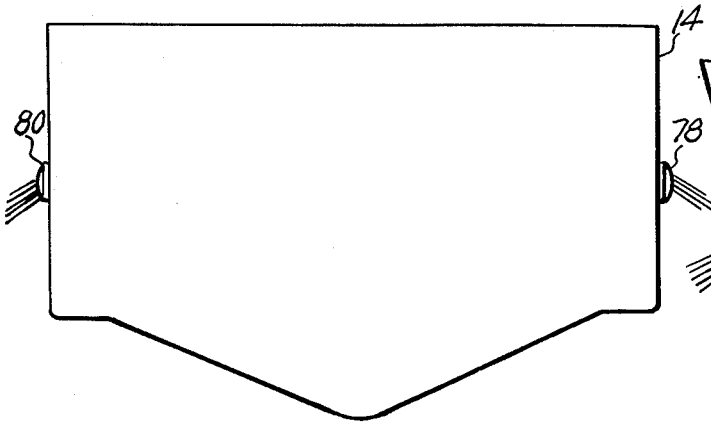
FIG. 4
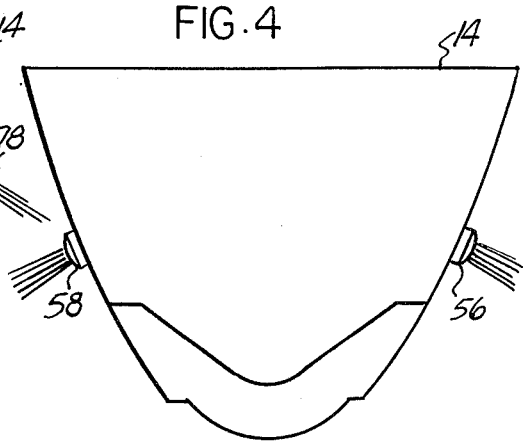

AUXILIARY HYDRAULIC MANEUVERING SYSTEM FOR SMALL BOATS

BACKGROUND OF THE INVENTION

The greatly increased popularity of small boats has led to the establishment of numerous marinas for providing dock and mooring space therefor. Due to the limited shoreline space available, however, these marinas have become increasingly crowded with a corresponding difficulty of maneuvering the small boats entering and leaving the marina and docking in their individual mooring spaces. This calls for considerable skill and experience on the part of the boat owner in entering and leaving the marina, with the sole assistance of the conventional rudder and motor-driven propeller. Such skill and experience has often been lacking in boat operators, with the result that collisions have frequently occurred. The present invention provides an auxiliary hydraulic maneuvering system for small boats which greatly facilitates entering and leaving the marina and docking or undocking of the boat therein. When the operator has cleared the marina or is out of crowded or restricted waterways, he switches over to the conventional steering arrangement with which his boat is equipped, such as the rudder or steerable outboard engine.

SUMMARY OF THE INVENTION

The invention chiefly resides in the provision of downwardly and outwardly-inclined nozzles disposed at various locations around the boat hull above the water line thereof and supplied with water under pressure from a hydraulic pump under the selective control of a multiple valve unit, thereby providing forward, backward and sidewise downward and outward thrust as desired and rendering easy not only approaching and departing from the marina or restricted waterway, but also working the boat around the individual dock or wharf.

In the drawings,

FIG. 1 is a diagrammatic central vertical longitudinal section through a small boat equipped with the auxiliary hydraulic maneuvering system of the present invention, looking in the direction of the arrows 1—1 in FIG. 2;

FIG. 2 is a diagrammatic top plan view, partly in horizontal section, taken along the line 2—2 in FIG. 1;

FIG. 3 is a diagrammatic vertical cross-section taken along the line 3—3 in FIG. 1;

FIG. 4 is a diagrammatic vertical cross-section taken along the line 4—4 in FIG. 1;

Figure 7:
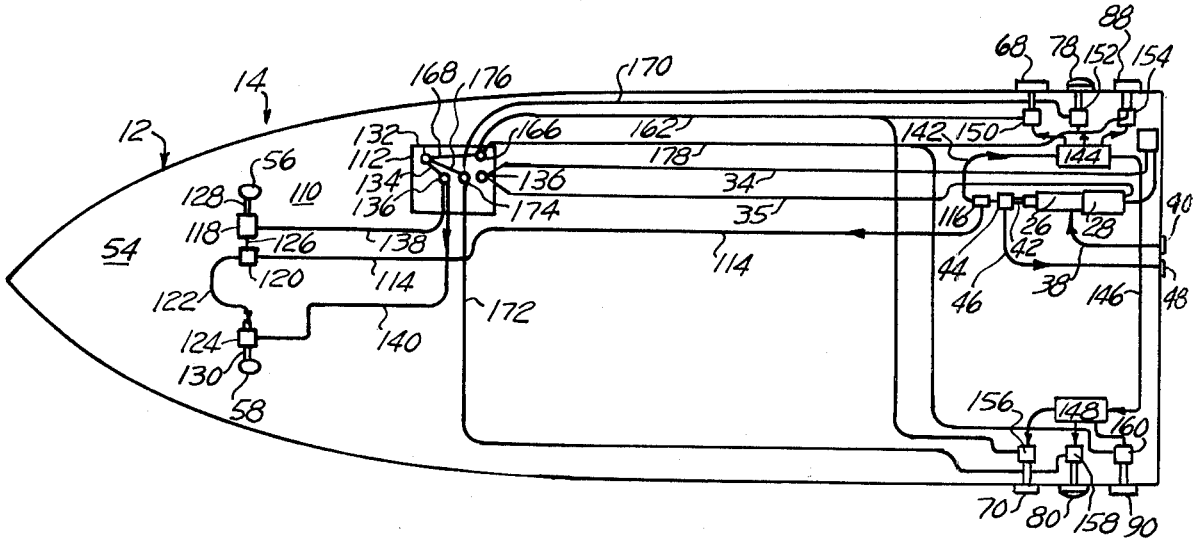
FIG. 7 is a horizontal view similar to FIG. 2 but showing a modification wherein the various nozzles are controlled by solenoid-operated valves energized from a central control switch unit.

Referring to the drawings in detail, FIGS. 1 and 2 show an auxiliary hydraulic maneuvering system, generally designated 10, for a small boat 12 according to a preferred form of the invention. The boat 12 has the usual hull 14 floating at the water line 15. The hull 14 has a cockpit 16 equipped at its forward end with an instrument board 18 from which a bracket structure 20 extends rearwardly to a control panel or shelf 22. Mounted on the shelf 22 which is adjacent the operator's seat (not shown) is a hydraulic steering control valve unit 24 from which the operator selectively controls the discharge of water under pressure from a hydraulic pump 26 driven by any suitable power source, generally designated 28, such as by an internal combustion engine (not shown) or by the electric motor 28 energized by a storage battery 30 through cables 32 and 34, the latter containing an off-on pump motor control switch 36.

The hydraulic pump 26 is provided with an intake conduit 38 leading thereto from an intake check valve 40 and is also provided with a discharge conduit 42 leading from the pump 26 by way of a relief valve 44 from which a bypass conduit 46 leads to a discharge opening or outlet 48 on the stern or transom 50 of the boat 12. The hydraulic pressure discharge conduit 42 leads from the relief valve 44 to an intake connection 52 of the control valve 24.

In order to maneuver the boat 12 in restricted or crowded waterways, the auxiliary hydraulic maneuvering system 10 provides the hull 14 with a multiplicity of hydraulic discharge nozzles which are mounted above the water line 15 thereof in downwardly and outwardly-inclined positions and which are regulated by the control valve 24 to discharge downwardly and outwardly-inclined jets of water under pressure. In particular, the forward portion or bow 54 of the hull 14 is provided with starboard and port bow thrust nozzles 56 and 58 respectively (FIGS. 2 and 4) so mounted and connected by hydraulic pressure bow supply conduits 60 and 62 respectively, leading to the bow thrust control valve 64 of the control valve unit 24. The rearward portion or stern portion 66 of the hull 14 is provided with starboard and port backward nozzles 68 and 70 positioned so mounted and to discharge downward and forward (FIG. 1) in an inclined path and supplied from the backward control valve 72 of the control valve unit 24 with hydraulic pressure fluid through a backward supply conduit 74 leading to the starboard backward nozzle 68 from which a branch hydraulic pressure supply conduit 76 leads to the port backward nozzle 70 (FIG. 2). The nozzles 68 and 70 when thus supplied with hydraulic pressure fluid impart a backward thrust to the hull 14.

Adjacent to but mounted rearward of the backward nozzles 68 and 70 are starboard and port sidewise thrust nozzles 78 and 80 respectively (FIGS. 2 and 3) so mounted and supplied alternately with hydraulic pressure fluid from the control valve unit 24 by way of the hydraulic pressure fluid supply conduits 82 and 84 respectively which, when activated, discharge jets of hydraulic pressure fluid inclined downward and outward perpendicular to the center line of the hull 14 and controlled alternately from the lateral thrust control valve 86 from the control valve unit 24.

Finally, the stern portion 66 of the hull 14 is provided with starboard and port forward thrust discharge nozzles 88 and 90 so mounted and respectively adapted to discharge jets of water under pressure and inclined downward and rearward (FIG. 1). The nozzles 88 and 90 are supplied with water under pressure from a hydraulic pressure supply conduit 92 running from the control valve 72 of the control valve unit 24 to the nozzle 86 and a branch conduit 94 extending from the starboard nozzle 86 to the port nozzle 88.

Figure 5:
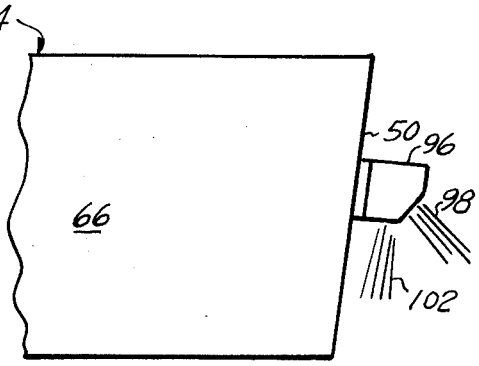
FIG. 5 is a fragmentary side elevation of the stern of the boat of FIGS. 1 to 4 inclusive, equipped with an additional stern thruster nozzle for forward maneuvering.
Figure 6:
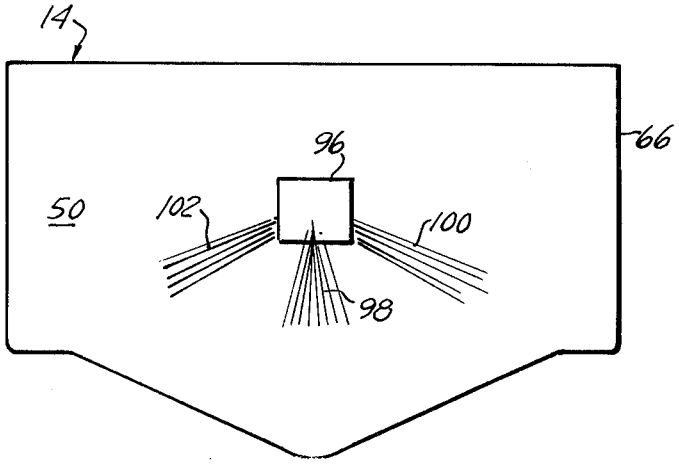
FIG. 6 is a rear elevation of the modification shown in FIG. 5.

The modification shown in FIGS. 5 and 6 on the transom 50 in the stern portion 66 of the hull 14 provides an amidships stern triple jet nozzle 96 which, when activated, selectively discharges a jet 98 of hydraulic pressure fluid in an inclined downward and backward direction or a starboard jet 100 or a port jet 102 according to the setting of a suitable conventional multiple position hydraulic fluid distribution control valve (not shown). Such valves have been hitherto well-known in the hydraulics art as having a housing with a pressure fluid inlet port and a plurality of spaced fluid outlet ports selected in response to the rotation or reciprocation of a rotary or recipricatory valve member containing a fluid passageway selectively alignable with these ports. The particular control valve chosen herein is beyond the scope of the present invention.

The operation of the auxiliary hydraulic small boat maneuvering system 10 shown in FIGS. 1 to 6 inclusive is believed to be self-evident from the description of the construction and arrangement thereof set forth above, so that only a brief narrative of the operation is believed to be necessary. At the outset, the operator starts the conventional boat engine (not shown) in the usual manner, then starts the pump-driving power source 28, such as the electric pump motor 28 by closing the pump motor control switch 36, whereupon the pump motor 28 is energized from the storage battery 30 by way of the electric cables 32 and 34. Until the hydraulic pump 26 is called upon to deliver hydraulic pressure fluid through the supply conduit 42 to the valve unit 24 and thence to one of the nozzles or sets of nozzles described above, it draws in water through the intake conduit 38 and intake check valve 40 and discharges it under pressure through the relief valve 44 and by-pass conduit 46 to the discharge outlet 48 on the stern or transom 50 of the boat 12.

To maneuver the boat 12 away from the dock, the operator opens the control valve 64 to either of its two discharge positions depending upon which direction he wishes to move the bow 54 away from the dock, thereby causing pressurized water to flow through either of the conduits 60 and 62 and thence to spurt downward and outward from either the starboard bow thrust nozzle 56 of the port bow nozzle 58 and move the bow 54 of the boat 12 in the desired direction away from the dock. By opening the control valve 72 to either of its two positions he can now back the boat by the release of pressurized water simultaneously to the backward nozzles 68 and 70 by way of the conduits 74 and 76. Alternatively, the operator can move the boat 12 forward or backward by opening the control valve 72 to either of its two positions in one of which it supplies pressurized water simultaneously to the starboard and port forward nozzles 88 and 90 through the conduits 92 and 94, or in the other of which it supplies pressurized water simultaneously to the starboard and port backward nozzles 68 and 70 by way of the conduits 74 and 76.

In addition to these maneuvers, the operator can move the boat 12 sidewise by moving the control valve 86 to either of its two positions to supply pressurized water to either the starboard sidewise nozzle 78 by way of the conduit 82 or to the port sidewise nozzle 80 by way of the conduit 84. In approaching the dock, the operator controls his boat direction by operating the same valves to accomplish the same directions of motion. It will be understood, of course, that supplying pressurized water to the starboard bow nozzle 56 causes the bow 54 to move to the left or port, whereas supplying pressurized water to the port bow nozzle 68 causes the bow 54 to move to the right or starboard. In approaching the dock and through restricted channels leading to the dock. The operator can maneuver the boat by manipulating these control valves 64, 72 and 86 in a similar manner. In this way, the operator can maneuver his boat safely and accurately through intricate and crowded waterways, as well as perform docking and undocking, or mooring to a mooring buoy in an improved manner.

The various motions or directions of maneuver of the boat are summarized in the following table:

| Thrust Nozzle | Thrust Nozzle Supply Conduit | Two-Position Nozzle Control Valve | Boat Motion from Nozzle Action |
|---|---|---|---|
| Stbd. Bow 56 | 60 | 64 | Bow moves to port |
| Port Bow 58 | 62 | | Bow moves to stbd. |
| Stbd. backward 68 | 74 | 72 | Boat moves astern |
| Port backward 70 | 74, 76 | | |
| Stbd. sidewise 78 | 82 | 86 | Boat moves sidewise to port |
| Port sidewise 80 | 84 | | Boat moves sidewise to stbd |
| Stbd. forward 88 | 92 | 72 | Boat moves forward |
| Port forward 90 | 92,94 | | |

The modified electric-valve-controlled auxiliary hydraulic small boat maneuvering system, generally designated 110 shown in FIG. 7 is similar in result to the system 10 shown in FIGS. 1 to 6 inclusive but instead of being manually valve-controlled, as in the system 10, the system 110 is solenoidal-valve-controlled from a multiple switch control unit, generally designated 112. As before the system 110 is installed in a hull 14 of a small boat 12 with a bow 54 and stern or transom 50. Corresponding parts in FIG. 7 are given the same reference numerals as the corresponding parts in FIGS. 1 to 4 inclusive. The arrangement of thrust nozzles is the same as shown in vertical section in FIG. 1. As in FIGS. 1 to 4 inclusive, water under pressure is delivered from a hydraulic pump 26 driven by any suitable pump-driving power source such as by the electric motor 28 energized by the storage battery 30 through the cables 32, 34 and 35 extending to and from the off-on pump motor control switch 36.

As before, the hydraulic pump 26 is provided with an intake conduit 38 leading thereto from an intake check valve 40, and is also provided with a discharge conduit 42 leading forward from the pump 26 by way of a relief valve 44 from which a bypass conduit 46 leads to a discharge outlet 48 in the stern or transom 50 of the boat 12. Control of the various switches about to be described is exercised by the operator from a control panel 112 mounted in a convenient location for actuation by the boat operator, usually in a position adjacent the rearward portion of the bow 54 in the cockpit on the starboard side.

From the relief valve 44, the conduit 114 leads forward from a tee 116 to a solenoidal starboard bow thrust control valve 118 by way of a tee 120 from which a branch supply conduit 122 leads to a solenoidal port thrust control valve 124. From the tee 120 a branch conduit 126 leads to the solenoidal starboard thrust control valve 118 from which a conduit 128 leads to the starboard bow thrust nozzle 56. Similarly, a conduit 130 leads from the solenoidal port bow thrust control valve 124 to the port bow thrust nozzle 58. Electrically for actuating the solenoidal valves 118 and 124 as well as the other solenoidal valves about to be described is obtained from an electric power source 132 such as a second storage battery from which an electric current supply cable 134 runs to a two-way bow valve control switch 136, from the latter of which run cables 138 and 140 to the solenoidal starboard and port valves 118 and 124 respectively. The switch 136 is mounted on the control panel 112.

Returning to the hydraulic pump 26, hydraulic pressure fluid flows from the tee 116 through a conduit 142 to a starboard manifold 144 from which a conduit 146 extends to a port manifold 148. As shown in the upper right-hand corner of FIG. 7, the starboard manifold 144 is triply connected hydraulically to solenoidal valves 150, 152, and 154 which control fluid flow through the starboard backward thrust nozzle 68, the starboard sidewise thrust nozzle 78 and the starboard forward thrust nozzle 88 respectively. Similarly, the manifold 148 is triply connected hydraulically to solenoidal valves 156, 158 and 160 which control the flow of hydraulic pressure fluid through the port backward thrust nozzle 70, the port sidewise thrust nozzle 80 and the port forward thrust nozzle 90 respectively.

The starboard and port backward thrust nozzle solenoidal valves 150 and 156 are supplied with electricity through cables 162 and 164 controlled by a two-way switch 166 which in turn is supplied with electricity through a line 168 from the electric power source 132. Similarly, the sidewise thrust nozzle solenoidal valves 152 and 158 are supplied with electricity through cables 170 and 172 controlled by a two-way switch 174 which in turn is supplied with electricity through a line 176 from the electric power source 132. And finally, the starboard and port forward thrust nozzle solenoidal valves 154 and 160 are supplied with electricity through cables 178 and 180 controlled by the two-way switch 166 which, as previously stated, is supplied with electricity through the line 168 from the electric power source 132.

The operation of the auxiliary hydraulic small boat maneuvering system 110 shown in FIG. 7 is generally similar to that of the system 10 described above and differs mainly in controlling the various hydraulic thrust valves and their adjacent nozzles by electricity from the remotely-located multiple switch control unit 112. To maneuver the boat 12 away from the dock, the operator again opens the solenoidal control valve 118 or 124 depending upon in which direction he moves the bow 54 away from the dock, by actuating the valve thrust nozzle control switch 136 controlling the flow of electricity to the selected solenoidal valve 118 or 124. This causes the water to spurt downward and outward away from the starboard or port bow thrust nozzle 56 or 58, depending upon the selection. As before, the operator can move the boat 12 forward or backward by shifting the contro switch 166 to either or its two positions, energizing the solenoidal valves 154 and 160 or 150 and 156 to open either the forward thrust nozzles 88 and 90 or the backward thrust nozzles 68 and 70 according to the setting of the control switch 166. Finally, the operator can move the boat 12 sidewise in either direction to starboard or port by shifting the control switch 174 to either of its two positions energizing either the solenoidal valve 162 or 158 and consequently causing water under hydraulic pressure to spurt downward and outward from the starboard sidewise nozzle 78 or the port sidewise nozzle 80, according to the selection made and the position to which the control switch 174 is shifted.

During such maneuvers, the operation of the hydraulic pump 26 and its accessories remains the same as described above in connection with the operation of the maneuvering system 10. It will be understood also that the operation of the modified maneuvering system 110 can be modified by fitting the stern-mounted thrust nozzle 96 of FIGS. 5 and 6 with an appropriate solenoidal valve controlled by an appropriate switch, preferably located on the control panel 112.

It will be further understood that the engine (not shown) of the boat 12 may be stopped during the use of either of the maneuvering systems 10 or 110 so as to utilize only the hydraulic maneuvering nozzles for precision handling of the small boat 12. As previously stated, the use of the auxiliary hydraulic maneuvering system 10 or 110 is not intended to provide propulsion of the small boat 12 in open water in which situation the conventional steering arrangement of the boat 12 either by its rudder or by the swinging of the outboard motor if the boat is so provided, for steering.

Figure 8:
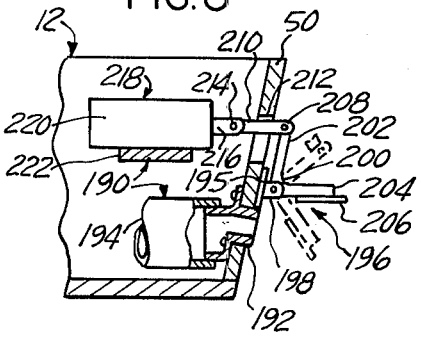
FIG. 8 is a view similar to FIG. 5, but showing a modification wherein a stern thruster nozzle is equipped with an additional reversing jet flow deflector for backing maneuvering.

The forward and backward boat-maneuvering device, generally designated 190 shown in FIG. 8, enables the boat operator to move his boat forward or backward using only a single rearwardly-directed jet thrust nozzle 192 bolted or otherwise secured to the stern or transom 50 of the boat 12 and connected to the power-driven hydraulic pump 26 by a conduit 194 leading to the control valve unit 24. Bolted or otherwise secured to the transom 50 above the jet thrust nozzle 192 is the base 195 of a jet flow deflector, generally designated 196.

Mounted on the base 195 is a horizontal pivot pin 198 upon which is pivotally mounted a bell crank lever 200 with upper and lower arms 202 and 204 respectively. Secured to and preferably cast integral with the lower arm 204 is a jet flow deflector plate 206 which in its raised and non-deflecting position is substantially horizontal and in its lowered jet flow deflecting position shown in dotted lines in FIG. 8 extends across the path of the jet stream to cause it to flow downward and forward from the nozzle 192.

The upper end of the upper arm 202 of the bell crank lever 200 is pivotally connected by a pivot pin 208 to the rearward end of a link 210 which passes in a forward direction through a vertical slot 212 in the transom 50. The forward end of the link 210 is pivoted at 214 to the operating rod 216 of a reciprocatory motor 218, such as a hydraulic cylinder 220 mounted upon the cross-shelf 222.

The operation of the boat-maneuvering device 190 is believed to be self-evident from the foregoing description of the construction. Suffice it to say that when the bell cranklever 200 is rotated counterclockwise into its solid line position (FIG. 8) by the reciprocatory motor 218, the jet thrust flow from the nozzle 192 spurts downward and rearward to move the boat 12 forward.

Where, however, the bell crank lever 200 is rotated clockwise into the dotted line position, it interposes the deflector plate 206 in the path of the nozzle 192; the jet flow is thereby deflected downward and forward to back the boat 12.

I claim:

1. A small boat with an auxiliary hydraulic maneuvering system comprising a hull with a bow portion and a stern portion and a transom behind the stern portion and with a water line at which the boat floats when immersed in water, a hydraulic pump having connected thereto a water intake conduit with a water inlet opening adapted to be mounted in the hull below the water line thereof, power-operated means for driving said pump, starboard and port bow thrust nozzles adapted to be mounted in and transversely to the hull bow portion on opposite sides thereof above the water line thereof in a downward and outward discharge direction relatively to said hull, starboard and port stern sidewise thrust nozzles adapted to be mounted in and transversely to the hull stern portion on opposite sides thereof above the water line thereof in a downward and outward discharge direction relatively to said hull, forward thrust nozzles adapted to be mounted in and transversely to the hull stern portion on opposite sides thereof above the water line thereof in a downward and outward and rearward discharge direction relatively to said hull, backward thrust nozzles adapted to be mounted in and transversely to the hull stern portion on opposite sides thereof above the water line thereof in a downward and outward and forward discharge direction relatively to said hull, hydraulic pressure discharge conduit means connecting said pump to said nozzles, control valve means disposed in said hydraulic pressure discharge conduit means between said pump and said nozzle means in flow-regulating relationship therewith, and means for shifting said control valve means between closed and open positions thereof.

* * * * *